US008213670B2

(12) United States Patent
Lai

(10) Patent No.: US 8,213,670 B2
(45) Date of Patent: Jul. 3, 2012

(54) SLEEP AID SYSTEM AND METHOD

(75) Inventor: Wei-Shin Lai, Bellefonte, PA (US)

(73) Assignee: AcousticSheep, LLC, Bellefonte, PA (US)

( * ) Notice: Subject to any disclaimer, the term of this patent is extended or adjusted under 35 U.S.C. 154(b) by 1062 days.

(21) Appl. No.: 12/134,463

(22) Filed: Jun. 6, 2008

(65) Prior Publication Data

US 2008/0304691 A1 Dec. 11, 2008

Related U.S. Application Data

(60) Provisional application No. 60/942,578, filed on Jun. 7, 2007.

(51) Int. Cl.
*H04R 1/02* (2006.01)

(52) U.S. Cl. ..... 381/388; 381/333; 381/376; 2/171.8

(58) Field of Classification Search ..... None
See application file for complete search history.

(56) References Cited

U.S. PATENT DOCUMENTS

| | | | | |
|---|---|---|---|---|
| 4,918,757 | A * | 4/1990 | Janssen et al. | 2/171 |
| 4,937,885 | A * | 7/1990 | Gregg | 2/209.11 |
| 5,135,468 | A | 8/1992 | Meissner | |
| 5,329,592 | A * | 7/1994 | Altman | 381/379 |
| 5,356,368 | A | 10/1994 | Monroe | |
| 5,625,903 | A * | 5/1997 | Schultz et al. | 2/209 |
| 5,881,390 | A * | 3/1999 | Young | 2/209.13 |
| 7,202,774 | B2 | 4/2007 | Hoyle | |
| 7,310,427 | B2 * | 12/2007 | Retchin et al. | 381/380 |
| 2005/0123151 | A1 * | 6/2005 | Whipple | 381/103 |
| 2007/0171628 | A1 * | 7/2007 | Seade | 362/106 |

* cited by examiner

*Primary Examiner* — Yuwen Pan
*Assistant Examiner* — Taunya McCarty
(74) *Attorney, Agent, or Firm* — St. Onge Steward Johnston & Reens LLC

(57) ABSTRACT

A sleep aid system, including a band adapted for surrounding a person's head, the band including an inside fabric layer and an outside fabric layer, two speakers between the fabric layers, the speakers positioned substantially opposite to one another, and an audio input for receiving audio from an audio player.

25 Claims, 3 Drawing Sheets

SLEEP AID SYSTEM AND METHOD

CROSS-REFERENCE TO RELATED APPLICATIONS

This application claims priority benefits under 35 § U.S.C. 119(e) of the U.S. Provisional Application No. 60/942,578, filed on Jun. 7, 2007.

FIELD OF THE INVENTION

The invention relates to a system and method for sleep aid, and more specifically to a sleep aid system including headphones designed specifically for sleeping. Thin adjustable speakers are sewn into comfortable fabric that can be worn like a sweatband or a watch cap. The speakers can play various sounds from music to binaural beats for the purpose of sleeping, awakening, meditation, or any general purpose audio.

BACKGROUND OF THE INVENTION

In the personal audio delivery systems, there have been many different methods to juxtapose a speaker next to the ear canal. The traditional headphone ("over head") has a plastic or metal headband across the top of the head with speakers encased in plastic on either side. The cord for the traditional headphone protrudes from either both speakers or just one speaker and is worn on the front of the individual. Newer designs for headphones include a plastic band that is worn across the occipital portion of the head ("behind head"), connecting the two speakers with a wire that could be worn on the front or the back. There are also the in-ear headphones ("earbuds") with wires from both speakers that may be worn inside the ear canal.

None of these common personal audio delivery systems are very comfortable when worn during sleep. The problem with the "over head" and "behind head" headphones is that they use a hard material like plastic or metal to hold the shape. The individual wearing headphones to sleep would not be able to lie on the back with the "behind head" design, and lying on the side would be extremely uncomfortable with either design due to the bulk of the plastic or metal-enclosed speakers. They are unlikely to stay in place for an extended period of time with normal sleep head movements. The "earbuds" design may stay on better, but is often irritating to the soft ear cartilage. When they are worn for an extended period of time, the hard components may actually cause ulcers in the thin skin of the ears, and an inability for the ear canal to be ventilated may predispose the wearer to fungal or bacterial ear canal infections.

U.S. Pat. No. 7,202,774 to Hoyle discloses an eye shield sleeping device including a pair of speakers. The speakers are attached externally to an elastic strap to cover a user's ears. The device disclosed in Hoyle is however intended for naps, such as while traveling or at work, and it is not suitable for extended sleep. For example, the size and means of attachment of the speakers are not amenable to different sleep positions (e.g., lying on one's side) and sleep movements.

Personal audio delivery systems are necessary for the effects of a phenomenon of brainwave entrainment through binaural beats. There are various brainwaves from gamma ($\gamma$, 26-100 Hz) to delta ($\delta$, 4 Hz), which represent a spectrum from awake and concentrating to deep sleep, respectively. The brain can be entrained to certain brainwave patterns by the delivery of sounds to the ears. More precisely, when two tones of a similar pitch are delivered to the individual ears, the brainwaves may then take on the pitch frequency difference. Meanwhile, because the 2 tones are so similar, the conscious mind will not sense this pitch difference. For example, when a 210 Hz frequency tone is presented to the right ear, and a 200 Hz tone is presented to the left ear, the superior olivary nucleus of the brain will integrate these two tones and induce a 10 Hz brainwave. A 10 Hz brainwave is generally an alpha ($\alpha$, 8-12 Hz) wave, which corresponds to a state of relaxed consciousness. This third brainwave frequency is considered the binaural beat, which has occurred through the sound delivery to the two ears.

Therefore, brainwaves can be entrained to take on a certain pattern via the delivery of specific tones to the ears. With the right audio sounds, the brain can be "programmed" to fall asleep or to wake up. Note that the sounds must be in stereo and be presented to the ears distinctly, not mixing in the air before entering the ear canals. This principle is called "stereo separation." Thus, the binaural beat effect can only be produced by wearing personal audio equipment, such as headphones. For one to sleep using binaural beats, one must wear a personal audio delivery system, and comfortable equipment would of course be preferred.

Some systems for varying the brain state and/or inducing states of consciousness using binaural beats are known. See, e.g., U.S. Pat. No. 5,135,468 and U.S. Pat. No. 5,356,368. However, these prior systems simply employ conventional speakers or headphones. As such, the prior art systems are not suitable for extended and comfortable sleep.

It is therefore desired to provide a sleep aid system with headphones that are comfortable enough to sleep in all night long.

SUMMARY OF THE INVENTION

Accordingly, it is an object of the present invention to provide a sleep aid system including thin adjustable speakers enclosed in fabric for soft comfortable headphones that can be worn like a sweatband or a watch cap. It is a further object of the present invention to provide such a system with an audio player in communication with the speakers via a wired or wireless connection.

It is a further object of the invention to provide an improved system and method for inducing binaural beats for the purpose of brainwave entrainment.

These and other objectives are achieved by providing a sleep aid system including a sleep aid system, including a band adapted for surrounding a person's head, the band including an inside fabric layer and an outside fabric layer, two speakers between the fabric layers, the speakers positioned substantially opposite to one another, and an audio input for receiving audio from an audio player. In some embodiments, the sleep aid system includes a cap portion connected to the band for covering the user's head.

In some embodiments, the audio input includes at least one wire connected to each of the speakers and a plug, wherein the band includes an eyelet, and wherein the at least one wire extends from each of the speakers and through the eyelet. In other embodiments, the audio input includes a wireless audio input.

In some embodiments, the system also includes two enclosures between the fabric layers, each of the enclosures including one of the speakers, wherein at least one of the enclosures is slideable within the band. For example, the slideable enclosure may include a first cord extending from a first end of enclosure and a second cord extending from a second end of the enclosure, wherein each of the first and second cords extend through at least one of the fabric layers, and wherein the slideable enclosure is slideable by pulling one of the first and second cords.

Other objectives are achieved by providing a method for inducing sleep, including the steps of providing a band about a head of a person, wherein the band includes a first speaker within the band and a second speaker substantially opposite to the first speaker within the band, delivering audio at a first frequency via the first speaker, delivering audio at a second frequency via the second speaker, wherein the first frequency is different from the second frequency.

Other objects of the invention and its particular features and advantages will become more apparent from consideration of the following drawings and accompanying detailed description.

DETAILED DESCRIPTION OF THE INVENTION

The present invention is directed to a completely new design for headphones suitable for sleep and delivery of binaural beats. These are stereo headphones with thin speakers enclosed in fabric that can be worn around the head. The embedded speakers are thin, e.g., preferably one eighth (⅛) inch or less in thickness, thereby allowing for turning of the head from side to side without discomfort to the ears. The fabric allows for absorption of perspiration and oils and allows ventilation for the covered ear canals. The fabric is soft and comfortable enough to sleep in all night, and will hold the speakers in place for delivery of sound.

Figure 1:
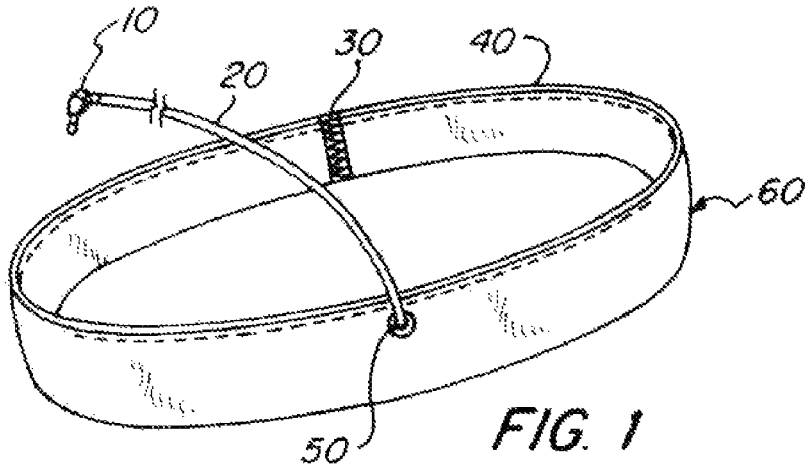
FIG. 1 shows an external view of one exemplary embodiment of the system according to the present invention including a sweatband style apparatus with a wire located in front.
Figure 2A:
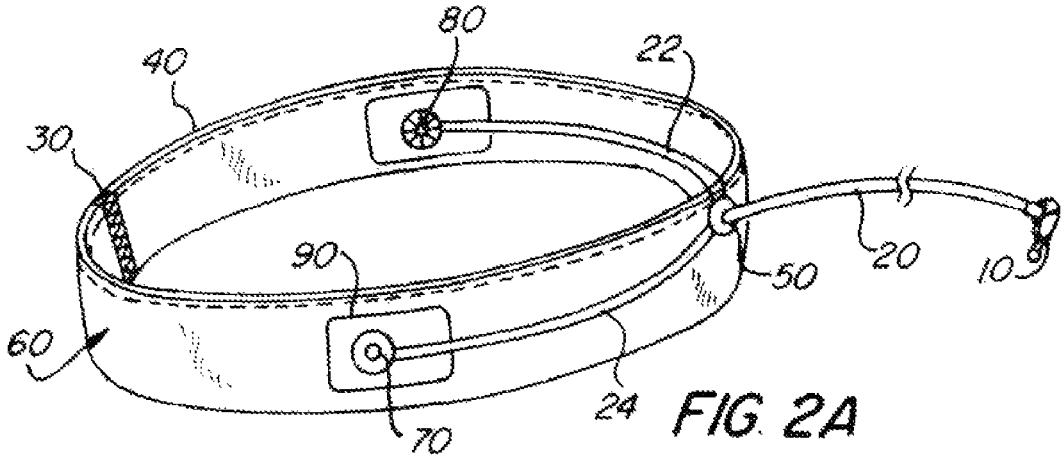
FIG. 2A shows an internal view of the system shown in FIG. 1.
Figure 2B:
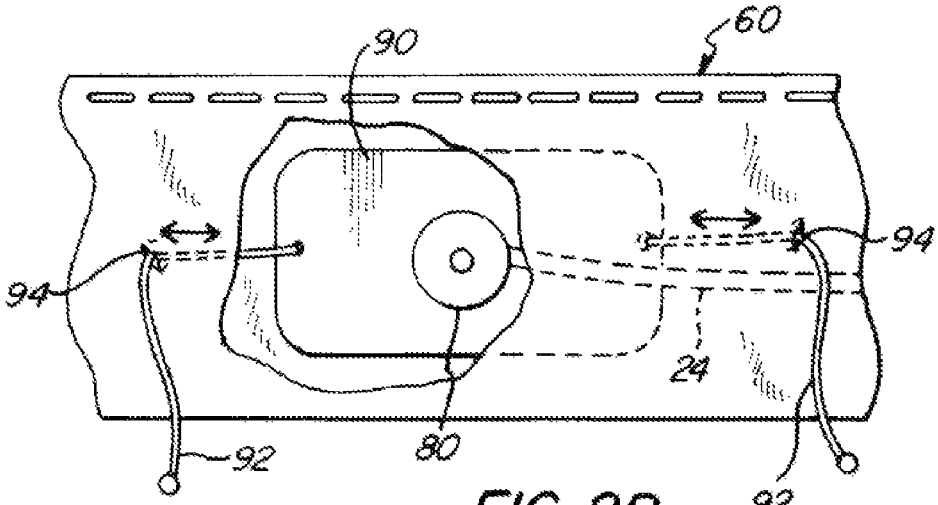
FIG. 2B shows a cutaway view of a portion of the system shown in FIGS. 1 and 2A.
Figure 3:
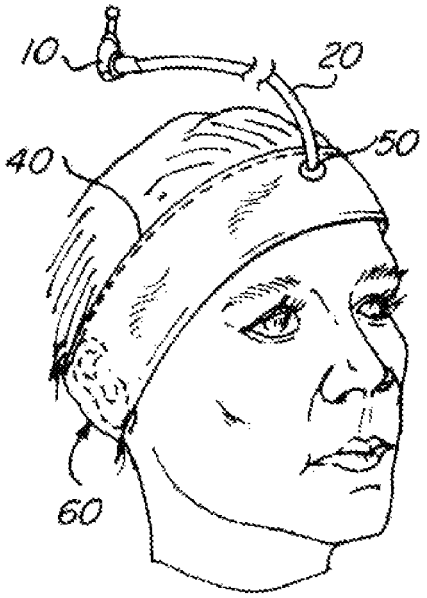
FIG. 3 shows an external view of the system shown in FIG. 1 worn by a person.

FIGS. 1-3 illustrate a first exemplary embodiment of a sleep aid system including an apparatus in the shape of a sweatband, similar to those worn for exercise. FIG. 1 shows an oblique frontal view of the sweatband style band 60. The band includes an inside fabric layer and outside fabric layer. In a preferred embodiment, the layers include a fleece fabric (e.g., polyester fleece). The fabric layers may be at least partially elastic, or the band may further include an elastic layer. The band 60 includes a seam 40 that seals the top of the band 60 and a seam 30 in the back to form the band shape. In the exemplary embodiment, the band 60 has a height of approximately two (2) inches. The band 60 may be manufactured with different circumferences to accommodate different head sizes.

An audio input (e.g., wire or cord) for connection to an audio player is located in the front of the band 60. The audio input in the exemplary embodiment includes a plug 10, such as a 3.5 mm (⅛ inch) stereo right-angle plug, and a cord 20 that enters at an eyelet 50 on the fabric band 60. In the exemplary embodiment, the cord 20 is approximately fifty (50) inches in length. In some other embodiments, the audio input is a wireless audio input. The audio player (not shown) may be, e.g., a portable media player, an iPod, a CD player, a tape player, a computer, or any device capable of providing audio in stereo to two or more speakers 80.

FIG. 2A shows an internal side view of the sweatband style embodiment of the sleep aid system. The plug 10 and cord 20 enters the fabric band 60 at the eyelet 50. The cord 20 then splits into left and right wires 22/24 and is connected (e.g., soldered) unto respective speakers 80. The speakers 80 and cord 20 are wrapped in thin flexible enclosures 90, such as fabric enclosures, for protection of the speakers 80 (e.g., and soldered joint 70). There is a seam 40 that seals the top of the band 60 and a seam 30 in the back to form the band shape.

As shown in FIG. 2A, the exact measurements and placement of the speakers 80 and wires 22/24 are important and adjustable for different head sizes. The speakers 80 are thin to ensure the comfort of the user in any sleeping position. The speakers 80 have a thickness of less than one quarter (¼) inch and preferably one eighth (⅛) inch or less. The wires 22/24 are soldered onto the speakers 80 or connected by any other suitable means. Then the speakers 80 are covered by the enclosures 90 to shield them from normal wear and tear. The speakers 80 are carefully placed to fit directly over the user's ears. The wire 20 is this particular embodiment is designed to protrude from the front of the head. Then the outer fabric is sewn into a sweatband shape.

FIG. 2B illustrates a cutaway side view of one of the speakers 80. The speaker 80 is wrapped and/or enclosed in the enclosure 90. The enclosure 90 may be slideably adjustable within the band 60. In the exemplary embodiment, the system includes two strings 92 attached to the enclosure 90 and extending through holes 94 or eyelets in the band 60. The location of the enclosure 90 and speaker 80 is adjustable by pulling on either one of the strings 92. In some embodiments, one of the speakers 80 is slideably adjustable. In other embodiments, both of the speakers 80 are slideably adjustable.

FIG. 3 illustrates a person wearing an exemplary embodiment of the sleep aid system. FIG. 3 shows the plug 10 and cord 20 entering the fabric band 60 at the eyelet 50. The top seam 40 is also pictured. As shown, the cord 20 preferably exits at the front of the band 60. This location of the cord 20 is intended for comfort of the person so that the person generally is not laying on the cord 20 and/or the eyelet 50 during sleep.

Figure 4:
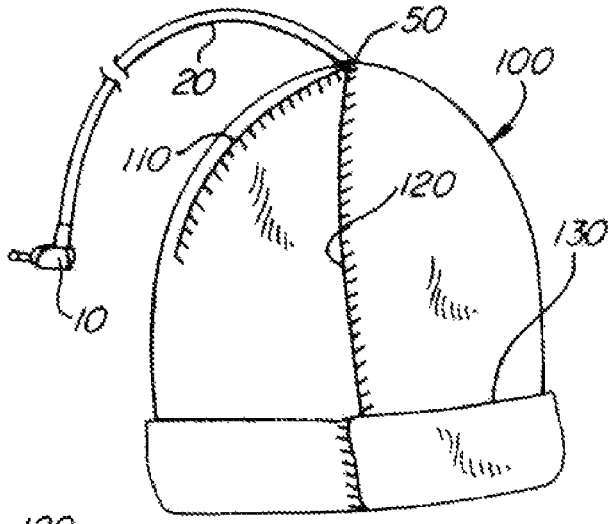
FIG. 4 shows an external view of another exemplary embodiment of the system according to the present invention including a watch cap style apparatus.
Figure 5:
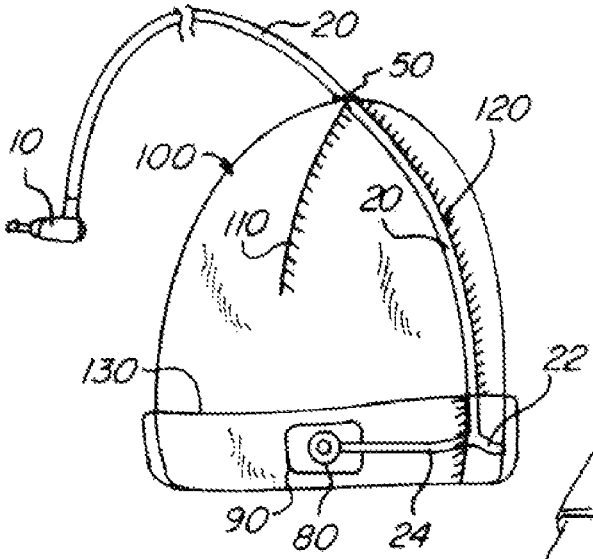
FIG. 5 shows an internal view of the system shown in FIG. 4.
Figure 6:
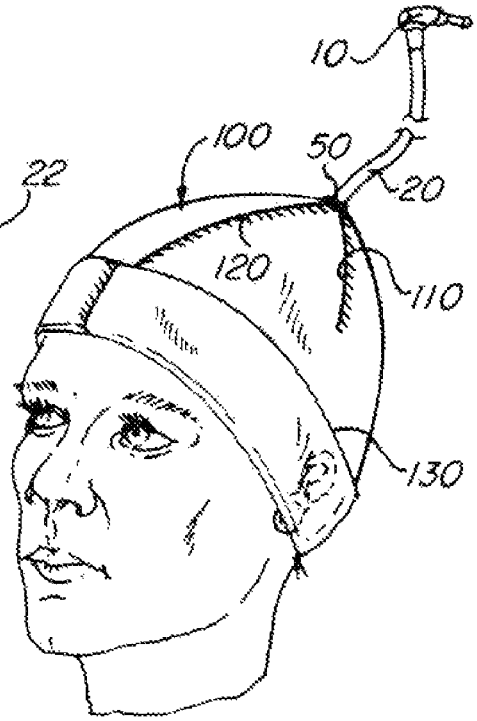
FIG. 6 shows an external view of the system shown in FIG. 4 worn by a person.

FIGS. 4-6 illustrate another exemplary embodiment of the system according to the present invention including an apparatus in the shape of a watch cap 100, like a beanie or sleeping cap. FIG. 4 illustrates an offset frontal view of the watch cap style apparatus. The cap includes an audio input including a 3.5 mm (⅛ inch) (⅛ inch) stereo right-angle plug 10 and a cord 20 that enters the fabric cap 100 at an eyelet 50. In other embodiments, the audio input may be wireless. There are seams 110 on the sides and seams 120 in the front to form the cap shape. The bottom of the cap 100 includes a folded layer or band 130 for style and comfort, and for enclosing the speakers 80. In the exemplary embodiment, the band 60 has a height of approximately two (2) inches.

FIG. 5 illustrates an offset side view of the watch cap style apparatus. FIG. 5 shows a partial internal view of the cap 100 to reveal the inside design. There is a 3.5 mm (⅛ inch) stereo right-angle plug 10 and a cord 20 that enters the fabric cap 100 at the eyelet 50. There are seams 110 on the sides and seams 120 in the front to form the cap shape. The bottom of the cap 100 includes a folded layer or band 130 for style and comfort, and for enclosing the speakers 80. The cord 20 travels down the front seam 120 and splits into right and left wires 22/24 which are soldered unto to the respective speakers 80. The speakers 80 and cord 20 are then covered with an enclosure 90, such as a fabric enclosure of piece of fabric, for protection of the soldered joint and the speaker assembly.

As shown in FIG. 5, the exact measurements and placement of the speakers 80 and wires 22/24 are important and adjustable for different head sizes. The speakers 80 are thin to ensure the comfort of the user in any sleeping position. The speakers 80 have a thickness of less than one quarter (¼) inch and preferably one eighth (⅛) inch or less. The wires 22/24 are soldered onto the speakers 80 or connected by any other suitable means. Then the speakers 80 are covered by the enclosure or fabric 90 for protection. The fabric 90 surrounding the speakers is sewn into place on the outer fabric, with adjustability. For example, at least one of the speakers 80 may be adjustable in the manner shown in FIG. 2B. Then the outer fabric is sewn into a watch cap shape.

FIG. 6 illustrates a person wearing the cap 100. FIG. 6 shows the plug 10 and cord 20 that enters the fabric cap 100 at the eyelet 50. Also shown are the seams 110 on the sides and seams 120 in the front to form the cap shape. The bottom of the cap 100 includes a folded layer or band 130 for style and comfort, and for enclosing the speakers 80.

Figure 7:
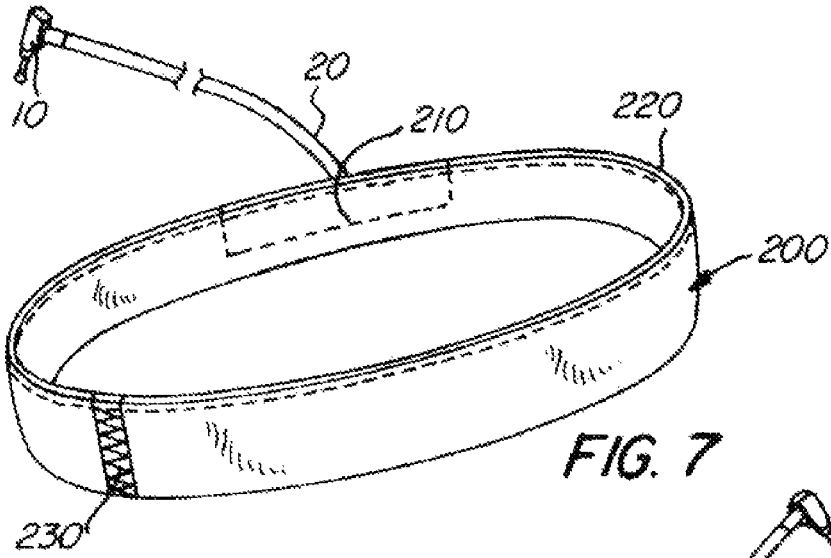
FIG. 7 shows an external view of another exemplary embodiment of the system according to the present invention including a sweatband style apparatus with a wire located in back.
Figure 8:
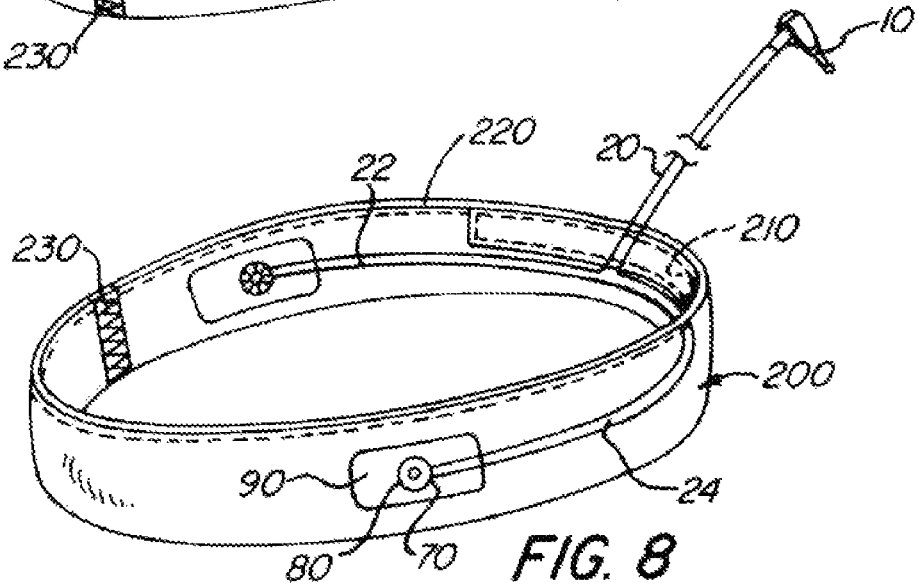
FIG. 8 shows an internal view of the system shown in FIG. 7.
Figure 9:
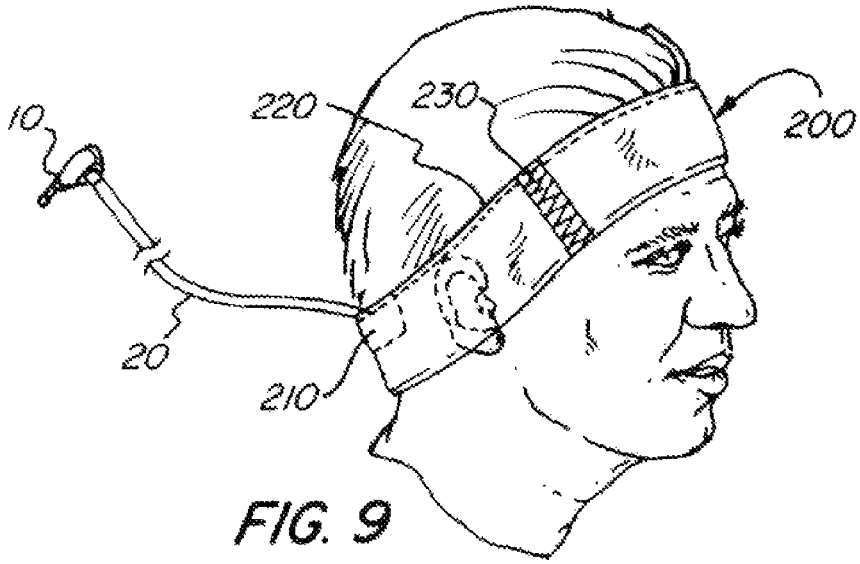
FIG. 9 shows an external view of the system shown in FIG. 7 worn by a person.

FIGS. 7-9 illustrate another embodiment including an apparatus in the shape of a sweatband. As shown in FIG. 7, the wire or cord 20 enters in the back of the apparatus. There is a 3.5 mm (⅛ inch) stereo right-angle plug 10 and cord 20 that enters the fabric band 200 via a re-sealable (e.g., Velcro) seam 210. There is a top seam 220 and a side seam 230 that forms the sweatband shape.

FIG. 8 shows an internal side view of the sweatband style, wire in back. As shown, the plug 10 and cord 20 enters the fabric band 200 via the Velcro seam 210. There is a top seam 220 and a side seam 230 that forms the sweatband shape. When the cord 20 enters the fabric, it splits into left and right wires 22/24 which are attached to the respective speakers 80 via a soldered joint 70. The speaker 80 and cord are covered by an enclosure or piece of fabric 90 to protect the soldered joint 70 and speaker assembly.

As shown in FIG. 8, the exact measurements and placement of the speakers 80 and wires 22/24 are important and adjusted for different head sizes. The speakers 80 are thin to ensure the comfort of the user in any sleeping position. The speakers 80 have a thickness of less than one quarter (¼) inch and preferably one eighth (⅛) inch or less. The wires 22/24 are soldered onto the speakers 80 or connected by any other suitable means. Then the speakers 80 are covered by the enclosure or fabric 90 to shield them from normal wear and tear. The speakers 80 are carefully placed to fit directly over the ears. The wire 20 is designed to protrude from the back of the head. The outer fabric is sewn into a sweatband shape. The outer fabric is removable from the internal electronics for washing. This design may be used for sleeping and for exercising.

FIG. 9 illustrates a person wearing the exemplary embodiment. FIG. 9 shows the plug 10 and cord 20 that enters the fabric band 200 via the Velcro seam 210. There is a top seam 220 and a side seam 230 that forms the sweatband shape.

The fabric in any embodiment may be updated for various reasons, such as style. The fabric may or may not be anti-odor, antimicrobial, breathable, waterproof, or flame-retardant. The stereo headphone design may have a cord with a plug, e.g., for communicating with an audio player. Alternatively, the device be wireless (e.g., using technology such as Bluetooth®). The device may be used with most audio devices for music, delivery of binaural beats, sounds inducing lucid dreaming, sleep learning, or any other sounds. Since the device may be worn comfortably all night, it may also be used for alarm clock functions. It may or may not be associated with a light to help with sleep or wake cycles. A website may or may not be created alongside this technology for MP3 downloads of binaural beat tracks.

The present invention is preferably used for delivering binaural beats to a user. Binaural beat technology is a way to induce brainwave patterns from beta (awake) to delta (deep sleep). Sound at a specific frequency is delivered to one ear and a slightly different frequency is delivered to the other ear. The user's brain senses this difference and generates a specific brain wave from deep in the brainstem. This entrains the rest of the brain to function at that brainwave frequency for a desired level of consciousness. The invention may include any number of audio tracks that can be played via the speakers. The audio tracks may, for example, include binaural beat technology which gradually reduces the user's brainwave frequency from beta to delta. The audio tracks may also include a morning track to gently awaken the listener back to beta waves.

Binaural beats must be delivered by stereo speakers directly to the ears. For a headphone to be useful for sleep, it must be comfortable and safe enough to wear while sleeping on the side. This invention therefore allows the user to wear stereo headphones while sleeping in any position.

Although the invention has been described with reference to a particular arrangement of parts, features and the like, these are not intended to exhaust all possible arrangements or features, and indeed many modifications and variations will be ascertainable to those of skill in the art.

What is claimed is:

1. A sleep aid system, comprising:

a band adapted for surrounding a person's head, said band comprising an inside fabric layer and an outside fabric layer;

two audio speakers between the fabric layers, said speakers positioned substantially opposite to one another;

at least two fabric enclosures between the fabric layers, each of said enclosures including one of said speakers, wherein at least one of said enclosures is slideable within said band;

an audio input for receiving audio signals from an audio player and directing them to said speakers and wherein the slideable enclosure includes a first cord extending from a first end of enclosure and a second cord extending from a second end of the enclosure, wherein each of the first and second cords extend through at least one of the fabric layers, and wherein the slideable enclosure is slideable by pulling one of the first and second cords.

2. The system according to claim 1, wherein each of said speakers has a thickness of less than about ¼ inch.

3. The system according to claim 2, wherein each of said speakers has a thickness of no more than about ⅛ inch.

4. The system according to claim 1, wherein the location of said speakers within said band is adjustable during use from the exterior of said band.

5. The system according to claim 1, wherein said audio input comprises at least one wire connected to each of said speakers and a plug;

wherein said band comprises an eyelet; and wherein the at least one wire extends from each of said speakers and through the eyelet.

6. The system according to claim 1, wherein said audio input comprises at least one wire connected to each of said speakers and a plug;

wherein said band comprises a re-sealable seam between a portion of the inside and outside layers; and wherein the at least one wire extends from each of said speakers and through the re-sealable seam.

7. The system according to claim 1, wherein said audio input includes a wireless audio input.

8. The system according to claim 1, wherein audio at a first frequency is provided to one of said speakers and audio at a second frequency is provided to a second one of said speakers, and wherein the first frequency is different from the second frequency.

9. The system according to claim 1, further comprising a cap portion connected to said band for covering the user's head.

10. The system according to claim 1, wherein said audio input is located at a front of said band.

11. The system according to claim 1, wherein at least one of the inside fabric layer and the outside fabric layer comprise a fleece fabric.

12. A method for inducing sleep, comprising the steps of:

providing a fabric band about a head of a person, wherein the band includes a first speaker within said band and a second speaker substantially opposite to the first speaker within said band;

delivering audio at a first frequency via the first speaker;

delivering audio at a second frequency via the second speaker;

wherein the first frequency is different from the second frequency;

wherein the band further includes at least two fabric enclosures within the band, each of the enclosures including one of first and second speakers wherein at least one of said enclosures is slideable within said band; and wherein the slideable enclosure includes a first cord extending from a first end of enclosure and a second cord extending from a second end of the enclosure, wherein each of the first and second cords extend through the fabric band, and wherein the slideable enclosure is slideable by pulling one of the first and second cords.

13. The method according to claim 12, wherein the location of at least one of the first and the second speakers within the band is adjustable, and wherein the method further comprises the step of adjusting a location of at least one of the first and second speakers relative to the band.

14. The method according to claim 12, wherein each of first and second speakers has a thickness of less than about ¼ inch.

15. The method according to claim 14, wherein each of the first and second speakers has a thickness of no more than about ⅛ inch.

16. A headphones apparatus, comprising:

a headband comprising an inside layer and an outside layer, at least one of the layers comprises a fabric;

two audio speakers in said headband between the layers, said speakers positionable substantially opposite to one another;

at least two fabric enclosures between the fabric layers, each of said enclosures including one of said speakers, wherein at least one of said enclosures is slideable within said headband;

an audio input connected to said audio speakers wherein the slideable enclosure includes a first cord extending from a first end of enclosure and a second cord extending from a second end of the enclosure, wherein each of the first and second cords extend through at least one of the inside and outside layers, and wherein the slideable enclosure is slideable by pulling one of the first and second cords.

17. The apparatus according to claim 16, wherein said audio input comprises at least one wire connected to said speakers and a plug;

wherein said headband comprises a hole; and wherein the at least one wire extends from said speakers and through the hole.

18. The apparatus according to claim 16, wherein said audio input comprises at least one wire connected to said speakers and a plug;

wherein said headband comprises a re-sealable seam; and wherein the at least one wire extends from said speakers and through the re-sealable seam.

19. The apparatus according to claim 18, wherein said speakers and the at least one wire are removable from said headband via the re-sealable seam.

20. The apparatus according to claim 16, wherein the fabric is at least partially elastic.

21. The apparatus according to claim 16, wherein the fabric is at least partially absorbent.

22. The apparatus according to claim 16, wherein each of said speakers has a thickness of no more than about ⅛ inch.

23. The apparatus according to claim 16, wherein the location of said enclosures within said headband is adjustable from the exterior of said headband.

24. The system according to claim 1, wherein each of said fabric enclosures has a height extending between a bottom edge and a top edge of said band, and a width extending lengthwise along said band, wherein the height of each of the fabric enclosures is at least twice a diameter of said speakers.

25. The apparatus according to claim 16, wherein each of said fabric enclosures has a height extending between a bottom edge and a top edge of said headband, and a width extending lengthwise along said headband, wherein the height of each of the fabric enclosures is at least twice a diameter of said speakers.

* * * * *